US008561649B1

(12) United States Patent
Legrand et al.

(10) Patent No.: US 8,561,649 B1
(45) Date of Patent: Oct. 22, 2013

(54) THREE-DIMENSIONAL SURFACE WEAVING

(71) Applicant: Airbus Operations (S.A.S.), Toulouse Cedex (FR)

(72) Inventors: Xavier Legrand, Roubaix (FR); Mathieu Piana, Nantes (FR); Georgi Tsarvarishki, Blagoevrad (BG); Julien Charles, Toulouse (FR); Philippe Blot, Nantes (FR); Dominique Guittard, Toulouse (FR)

(73) Assignee: Airbus Operations S.A.S., Toulouse (FR)

( * ) Notice: Subject to any disclaimer, the term of this patent is extended or adjusted under 35 U.S.C. 154(b) by 0 days.

(21) Appl. No.: 13/720,033

(22) Filed: Dec. 19, 2012

Related U.S. Application Data

(62) Division of application No. 12/445,580, filed as application No. PCT/EP2007/061459 on Oct. 25, 2007, now Pat. No. 8,361,911.

(30) Foreign Application Priority Data

Oct. 27, 2006 (FR) ..... 06 54580

(51) Int. Cl.
*D03D 11/00* (2006.01)
*D03D 13/00* (2006.01)
*D03D 25/00* (2006.01)

(52) U.S. Cl.
USPC ..... 139/11; 139/383 R; 139/DIG. 1; 139/116.1; 442/205; 442/203

(58) Field of Classification Search
USPC ..... 139/1 E, 11, 457, 16, 17, 17.5, 20, 24, 139/35, 55.1, 97, 208, 305
See application file for complete search history.

(56) References Cited

U.S. PATENT DOCUMENTS

| | | | | |
|---|---|---|---|---|
| 3,559,836 | A * | 2/1971 | Pink et al. | 206/557 |
| 3,813,739 | A * | 6/1974 | King | 28/143 |
| 3,943,980 | A * | 3/1976 | Rheaume | 139/384 R |
| 4,019,540 | A * | 4/1977 | Holman et al. | 139/20 |
| 4,671,470 | A * | 6/1987 | Jonas | 244/119 |
| 5,080,142 | A * | 1/1992 | Calamito et al. | 139/384 R |
| 5,280,558 | A | 1/1994 | Wiener | |
| 5,540,260 | A * | 7/1996 | Mood | 139/11 |
| 5,775,381 | A * | 7/1998 | Addis | 139/11 |
| 6,494,235 | B1 * | 12/2002 | Bruyere et al. | 139/11 |
| 7,413,999 | B2 * | 8/2008 | Goering | 442/181 |
| 8,001,998 | B2 * | 8/2011 | Legrand et al. | 139/11 |
| 2002/0192450 | A1 * | 12/2002 | Schmidt et al. | 428/299.1 |

(Continued)

FOREIGN PATENT DOCUMENTS

| | | |
|---|---|---|
| EP | 1 310 586 A2 | 5/2003 |
| GB | 854222 | 11/1960 |
| GB | 2 277 730 A | 11/1994 |
| JP | 6-264325 | 9/1994 |

*Primary Examiner* — Bobby Muromoto, Jr.
(74) *Attorney, Agent, or Firm* — Oblon, Spivak, McClelland, Maier & Neustadt, L.L.P.

(57) ABSTRACT

A weaving process for direct manufacture of three-dimensional structures with bidimensional walls with corners, without the need for sewing or other assembly between two ridges. The weaving is made by transforming weft threads into warp threads for making at least one face. The process is particularly adapted for the weaving of reinforcing elements for composite structures of corner fitting type.

9 Claims, 4 Drawing Sheets

(56) References Cited

U.S. PATENT DOCUMENTS

2003/0033008 A1* 2/2003 Schmitt et al. ..... 623/1.51
2004/0000613 A1* 1/2004 Thomas, Jr. ..... 244/10
2005/0084377 A1* 4/2005 Dambrine et al. ..... 416/223 R
2006/0257260 A1* 11/2006 Dambrine et al. ..... 416/230
2009/0223588 A1* 9/2009 Dunleavy ..... 139/384 R
2010/0269948 A1* 10/2010 Legrand et al. ..... 139/384 R
2010/0275764 A1* 11/2010 Egres, Jr. ..... 89/36.02
2010/0319801 A1* 12/2010 Legrand et al. ..... 139/11

* cited by examiner

THREE-DIMENSIONAL SURFACE WEAVING

CROSS REFERENCE TO RELATED APPLICATIONS

This application is a divisional of U.S. application Ser. No. 12/445,580, filed Dec. 18, 2009, which is incorporated herein by reference in its entirety. U.S. application Ser. No. 12/445,580 is a U.S. national stage application under 35 U.S.C. §371 of International Application No. PCT/EP07/61459 filed Oct. 25, 2007, which claims priority to French Application No. 06 54580 filed Oct. 27, 2006.

TECHNICAL FIELD

The invention relates to single-pass weaving of dense elements constituted by bidimensional walls organised according to different planes. The process according to the invention enables the production of flat fabrics arranged directly according to a three-dimensional form. Because of the process according to the invention, it is possible to dispense with sewing, or other joining means, in the fabrication of elements woven with several walls, of the type comprising one or more trihedral angles.

The invention applies particularly to making folds with one or more closed corners, and to weaving of fragile and/or abrasive fibres, especially fibres used in reinforcing fabrics of composite material, such as carbon.

PRIOR ART

Weaving has been employed since ancient times for making fabrics based on fibres organised in the form of process or of its use for textiles known as "technical", for example as reinforcements of composite materials, the current weaving process is based on the same bases as back then and, as such, has undergone minimal evolution.

In fact, all woven textiles comprise interlacing of threads divided into two categories: the "warp threads" are threads parallel to the selvedges of the fabric, and they are interlocked, according to a layout known as "weave", with a perpendicular series of "weft threads". The simplest weave consists of alternation in which each weft thread passes successively above and below a warp thread, with offset from one weft to the other ("plain weave").

To carry out weaving 1, such as illustrated in FIG. 1, the warp threads 2 are first rolled up on the same support, "the loom beam" 3, parallel to one another and over a width which will correspond to the width of the fabric 1; a "warp creel" is used to facilitate this operation in the case of fragile materials, but has considerable bulk. The weft thread 4 will be passed between the warp threads 2, each passage corresponding to a "pick". According to the type of pick vector, the web 2' of warp threads 2 can be prepared (for example by dressing) so as to increase its mechanical resistance, especially to friction.

The passage of each pick is facilitated by making a "weaving shed" 5 in the web 2', that is, by raising or lowering certain warp threads 2 relative to each other, such that an angular passing space 5 is created. To create the weaving shed 5, the warp threads 2 are returned to healds 6 which will undergo movement perpendicular to the web 2' coming from the loom beam 3. Different mechanisms (frame, Jacquard) create the weaving sheds according to the required weave.

The insertion of the pick 4 can be done using different processes. A classic old process comprises projection, across the web, of a shuttle 7, a tool which holds a pirn 8, the latter containing a winding of a certain length of weft thread 4.

Each time a pick is passed in the weaving shed, a comb 9 in the teeth of which the warp threads 2 are caught crams it onto the fabric 1 already formed, whereas the beams 6 are actuated to create another weaving shed 5 depending on the weave.

For technical fabrics especially, the solicitations complex can necessitate more consequential thicknesses, for example to obtain good compression or delamination resistance.

Classic superpositions, in which textiles are stratified into parallel layers not connected to one another, solve only the first problem. So-called "three-dimensional" weaving processes have consequently been developed, in which the product resulting from the weaving operation comprises interlacing of threads disposed according to the three directions of the space. In particular, Aerotiss® processes weave glass and carbon fibres with multilayer interlacing which can be used for making leading-edge skins for aircraft, inter alia.

For pieces of more complex form, braiding can be used: it makes pieces directly in the hollow form on a suitable mandrel. More simply, circular weaving machines have been developed which enable production of tubular structures; however, this solution is adapted only for cylindrical forms without marked angles, of jute bag type.

Therefore, for the majority of three-dimensional forms with bidimensional walls, the structures are actually made flat, sometimes by a Jacquard loom, then deployed to become dense. This method requires shaping sewing.

For example, in the aeronautical field, composite structures are developed to replace normally metallic elements of boxed structures (likewise known under the name "box"). However, for the junctions, "reinforcing corners" (or "corner fittings") are necessary, whereof the geometry seems simple: a classic corner fitting 10, illustrated in FIG. 2A, comprises for example three bidimensional walls 12, 14, 16, substantially flat, forming a corner cube angle (of "demi-cube" type) at the level of a corner 18. A reinforced textile preform of this structure 10 can however be made on existing machines only from a "flat" version of the walls, illustrated in FIG. 2B, and by means of sewing between at least two faces.

Now, sewing is an applied element, more or less fragile, which poses problems of mechanical behaviour not adapted to aeronautics. In addition, since the continuity of the fibres according to the different planes is not assured, the reinforcing function is not fully realised. In fact, corner fittings, even for boxed composite structures, are fabricated by a metallic support.

EXPLANATION OF THE INVENTION

One of the aims of the invention is to eliminate this disadvantage of existing weaving processes and to enable production of woven monobloc pieces comprising one corner angle at least. In particular, a structure of reinforcing fold type for a corner fitting, which has a geometry close to that of metallic mountings having three existing orthogonal planes or more, is realised: the continuity of the reinforcing textile fibres between two adjacent planes is assured.

Contrary to usage in weaving, according to the invention, a pick can act at the same time as weft thread and warp thread. This novel weaving technique ensures continuity of the warp threads and continuity of the weft threads between the different faces constituting the three-dimensional fold.

According to the invention, once the first face is woven, weaving will take place simultaneously on two webs, created respectively by the primary warp threads and the secondary warp threads, according to non-rectilinear insertion of the weft thread: the threads working initially as weft (inserted threads) then work as warp (threads forming the weaving shed).

Under one of its aspects, the invention thus concerns a weaving process of an item whereof the three-dimensional form is obtained by arranging surface walls comprising a closed corner, that is, a form extracted from a hexahedron, the process allowing continuity of the weaving threads between the walls and at the level of the corner.

According to the invention, a first face of the structure extracted from a hexahedron to be woven is selected to be woven initially, and the corresponding web of warp threads is put in place, the weaving being carried out as usual, with the exception of the fact that the weft inserted threads are extended on one side of the web, or even two sides, so as to form webs of threads to act as secondary ply threads.

Once the first face is woven, weaving will be carried out on the initial web and on the secondary web(s), with a change in direction of the pick to form an angle(s). The pick will be inserted according to two, three or four sides of the first face. Parallel to the passage of the pick, there is offset of the first face relative to the plane formed by the webs of warp threads, for example lowering by thrust on a surface close to the ridges, preferably perpendicular to this plane for a structure originating from a parallelepiped rectangle. The offset is executed each time a pick makes a complete "circuit" about the first face, with possible offset from completion of weaving of the latter.

The instances of weaving and offset can be done according to all orientations and weaves, and especially with a plain weave at a right-angle, with vertical offset, in particular if a trihedral angle is selected, so as to weave a corner cube angle with continuity of threads. The weft thread is preferably continuous for the weaving of the entire item.

In another aspect, the invention concerns an elementary fold made by the preceding process. More generally, the invention relates a woven elementary fold comprising at least three faces connected to one another by ridges to form a closed corner, and whereof the weaving wefts are continuous in the faces and at the level of the ridges, preferably parallel to the ridges and the weft thread is continuous for the weaving of the entire item.

The fold according to the invention can be a corner cube angle, and especially act as reinforcing textile for the fabrication of a composite corner fitting after injection of resin; it can also be a demi parallelepiped, whereof the cut-out for example can generate a trihedral angle acting as reinforcing for a corner fitting. The invention is likewise relative to such a corner fitting.

BRIEF DESCRIPTION OF THE DRAWINGS

Other characteristics and advantages of the invention will emerge more clearly from the following description and in reference to the attached drawings, given solely by way of illustration and not limiting.

DETAILED PRESENTATION OF PARTICULAR EMBODIMENTS

According to the invention, it is possible to manufacture a woven fold in three dimensions with continuity of threads between each adjacent face of the fold. This especially allows the formation of one or more corners without a stage other than the weaving.

The process according to the invention is based on offset, during the weaving phase, of the piece 2 already woven relative to the web 2' of warp threads; offset is preferably executed in a direction perpendicular to the web, advantageously downwards for horizontal weaving.

Figure 1:
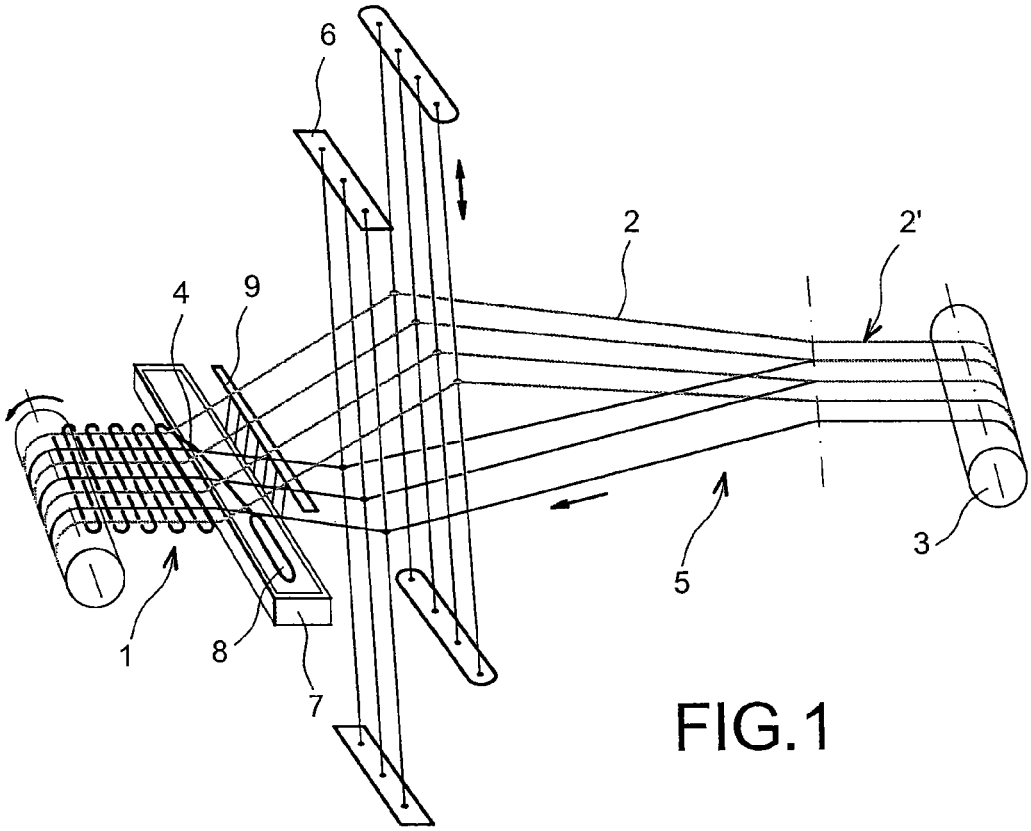
FIG. 1, already described, schematically illustrates a classic weaving process.
Figure 2A:
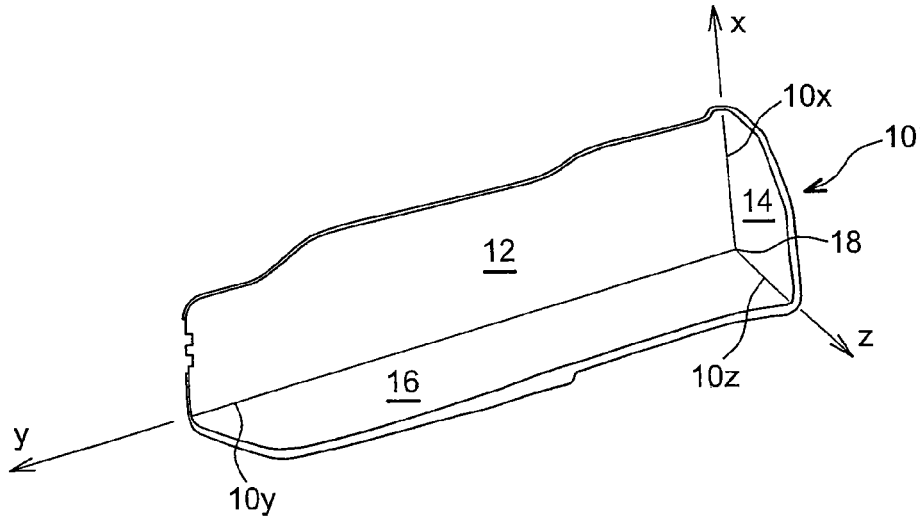
FIGS. 2A and 2B illustrate a corner fitting in form and in a flattened version, in an exploded view.
Figure 2B:
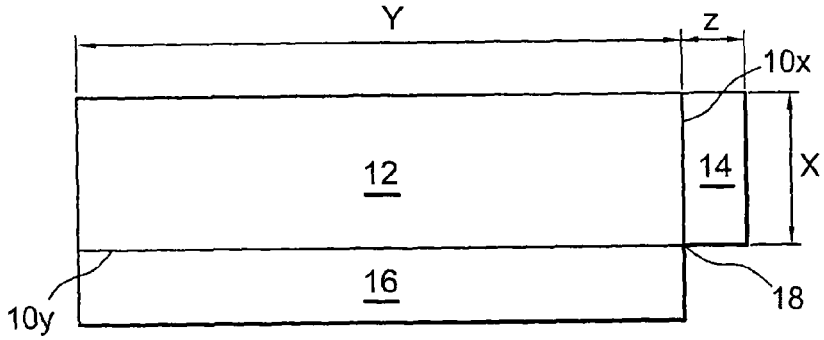

In a preferred embodiment, the process according to the invention concerns the weaving of a corner fitting 10 illustrated in FIG. 2, that is, of a corner cube angle comprising three orthogonal planes 12, 14, 16 connected according to three ridges 10*x*, 10*y*, 10*z*, of respective lengths X, Y, Z, which run together at a junction point or corner 18, forming a point with three axes x,y,z. Flat and by "bursting" according to a ridge 10*z*, this form corresponds to a square comprising three rectangular parts 12, 14, 16 corresponding to the three faces of the trihedral angle. It is clear that other angles can be selected.

To perform the weaving, one of the three faces is selected to be formed initially: a web 20 of warp threads 22 is placed to form this part of the square, for example the face 12 according to the plane x,y: the width X of the web 20 corresponds to that of one of the ridges 10*x*. Advantageously, the web 20 is formed from a single continuous warp thread 22.

Figure 3A:
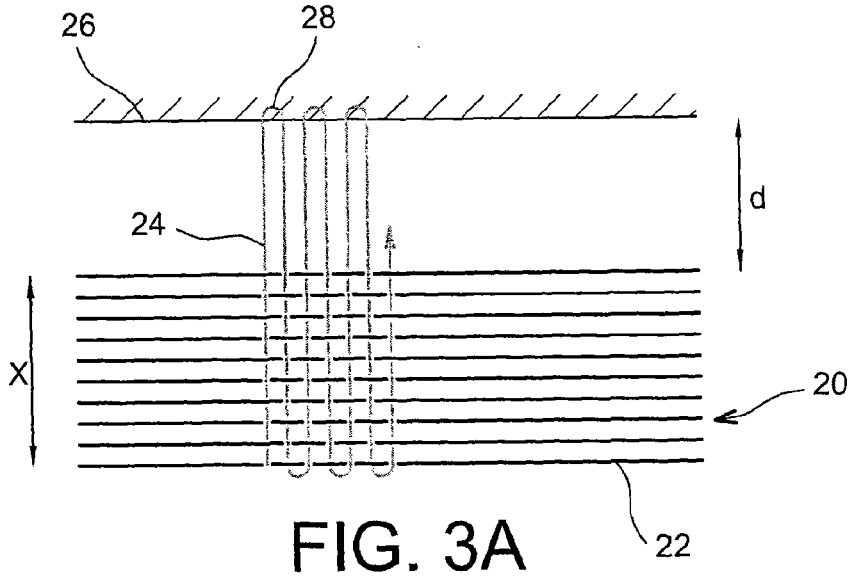
FIGS. 3A to 3E show the stages of weaving according to an embodiment of the invention.

The weaving is performed initially to form the first face 12: FIG. 3A. According to the weave, and in the case illustrated at right angles, the ("primary") weft thread 24 is inserted successively above and below the warp threads 22; this is advantageously done by formation of an adapted weaving shed.

However, from this stage, making one of the two other faces 16 is provided. Therefore, instead of stopping the weft threads 24 used to form the first face 12 at the level of the edges of the web 20, they extend along one side of a length d greater than that of the ridge 10*z* connecting the other faces 14, 16; the extension of the weft threads 24 is coupled to a frame 26 which helps keep it in position. Advantageously, the same weft thread 24 acts as weaving of the entire first face 12, and the weft threads 24 are coupled to the frame 26 by means of hooks 28 which they turn around.

Figure 3B:
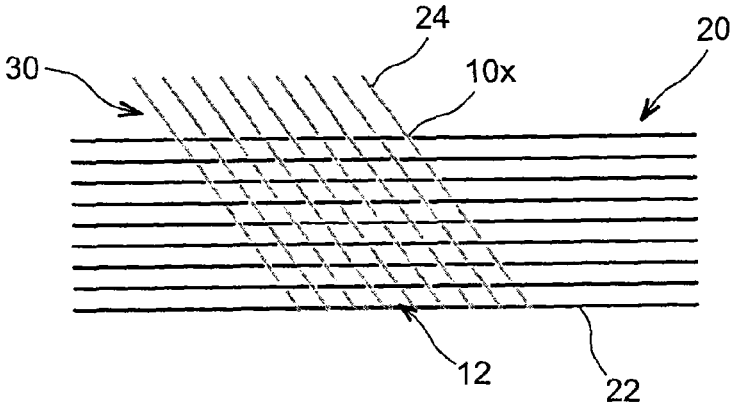

The result is a form illustrated in FIG. 3B comprising a first face woven 12 at a right-angled on a plane x,y, surrounded by warp threads 22 oriented according to the axis x and of a predetermined length, and extended along a second side on a length d by weft threads 24 oriented according to the axis y, orthogonal to the warp threads 22. Advantageously, the same weft thread 24 is used, and there is continuity at the level of each of the ends, namely at the level of the frame 26 and of the free edge of the face 12 opposite the future ridge 10*y*.

The two other faces 14, 16 are thus woven at the same time: the "primary" weft threads 24, which form a second web 30 corresponding to the second part 16 of the square, are from here on considered as "secondary" warp threads: weaving by a "secondary" pick will be done on this web 30, at the same time as on the web 20 of "primary" warp threads 22.

To form the corner 18 and the ridge 10*z* "in relief", there is parallel to the weaving of the two other faces 14, 16 an offset of the first face 12 relative to the plane x,y of the webs 20, 30. Advantageously, this stage is completed by thrust on a surface covering at least the edge of the ridges 10$x$, 10$y$ of the first face 12 and preferably its entire surface. The lowering depth is a function of the reduction of the weave (that is, of the number of threads per cm), for example ¼ cm for a reduction by 4 threads/cm. This allows optimised placement of the threads working in the direction z during weaving.

Figure 3C:
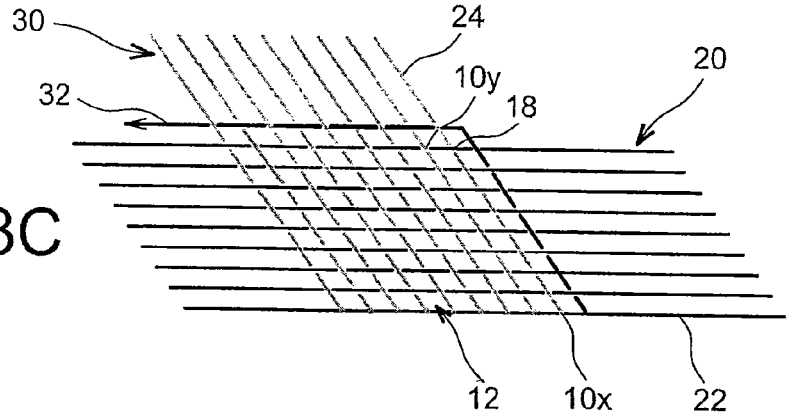

The offset comprises a component orthogonal to the plane x,y of the first face 12 and webs 20, 30, and it can be done before the secondary pick passes or once the latter has passed. For example, as illustrated in FIG. 3C, in a first instance, the secondary pick 32 is inserted into a weaving shed formed in one of the two webs 20, 30, specifically here between the primary warp threads 22, in a direction where it arrives at the level of the corner 18 between the two. The same weft thread 32 continuous with the thread 24 used for making the face 12 is preferably used. It is possible, although not obligatory, to cram the pick 32 once it passes by this second face 14.

Since continuity between the two faces 14, 16 of the fold is wanted at the level of the ridge 10$z$ and of the corner 18, the weft thread 32 has a residual length after this first passage sufficient to form the second pick. In fact, the weft thread 32 is then interlaced with the other web 30 situated at a defined angle of the preceding. Here, too, there possibly could be cramming of the pick 32 on the face already woven 12.

Lowering of the first face 12 according to the axis z is continued; in the frame illustrated and to form a corner cube angle, only one component according to the axis z is provided, but this can of course be modified. In parallel, cramming of the pick 32 is executed; this is why the two preceding crammings are executed only if needed: it is preferable to cram the pick 32 when it has passed the two webs 20, 30 so as to optimise the regularity of the threads, and once the height offset is completed to perfect the shaping.

Figure 3D:
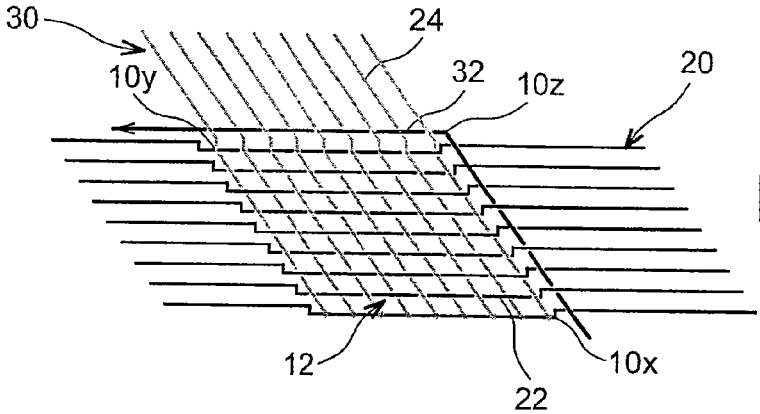

The result (FIG. 3D) is a form comprising a first face 12 and a woven thread 32 with a defined angle above one of the threads 22, 24 of the first face 12; two ridges 10$x$, 10$y$ are thus formed. In addition, the corner 18 is closed, the perpendicular thread 32 being continuous: a preform of the third ridge 10$z$ is formed.

The process is reiterated, with each time lowering of the first face of the thickness of the reduction of the warp, to obtain a corner cube angle.

It should be noted that according to an alternative, the procedure comprises offset in height, or lowering, of the first woven face 12 before passage of the secondary pick 32: for example, thrust means are positioned on the face 12 on completion of its weaving, at the level of the stage illustrated in FIG. 3B, offsetting the face 12 of the webs 20, 30 by a height corresponding to the reduction of the weave, then the secondary pick 32 is passed into the overhanging webs 20, 30, and it is thus crammed. This embodiment can be preferred according to the formation mode of the weaving shed and the predefined angle at the level of the ridges.

Figure 3E:
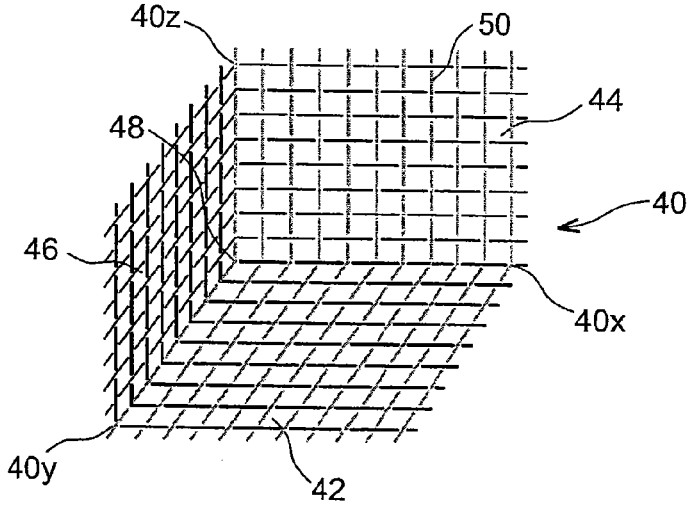

After appropriate cut-out the result is an elementary fold 40, illustrated in FIG. 3E, in which three faces 42, 44, 46 orthogonal to one another are connected at the level of the three ridges 40$x$, 40$y$, 40$z$ joining together in a corner 48 and are woven, the weaving weft 50 being parallel to the ridges 40$x$, 40$y$, 40$z$ and the weft threads 50 being continuous between the faces 42, 44, 46.

Figure 4A:
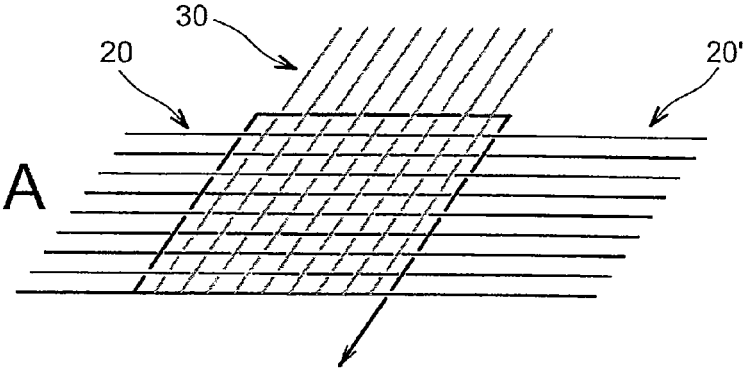
FIGS. 4A and 4B illustrate two alternatives to the weaving according to the invention.
Figure 4B:
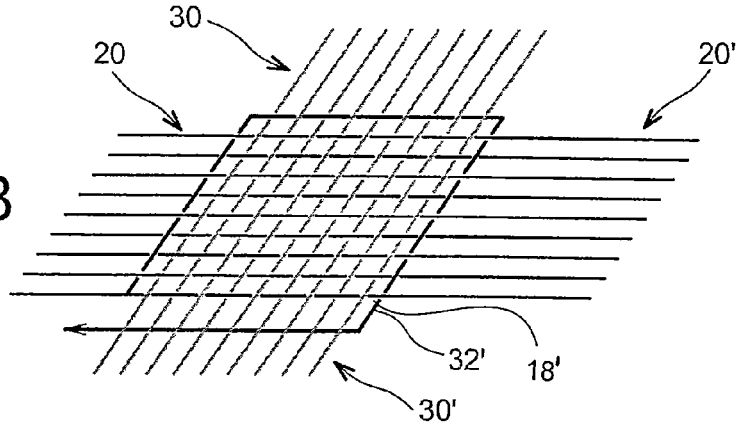

In the process according to the invention, it would be possible to close three or four angles, by continuing the weaving on the web 20' of primary ply threads (FIG. 4A) on the other side of the face 12; it is likewise possible to create a second web 30' of secondary ply threads vis-à-vis the preceding 30 (FIG. 4B) relative to the initial web 20.

If four angles are formed (FIG. 4B), it is possible to leave one of them 18' open, by having the pick 32' return on itself once the four faces are passed, or likewise close this corner 18' by having the pick follow in the same direction.

Figure 5:
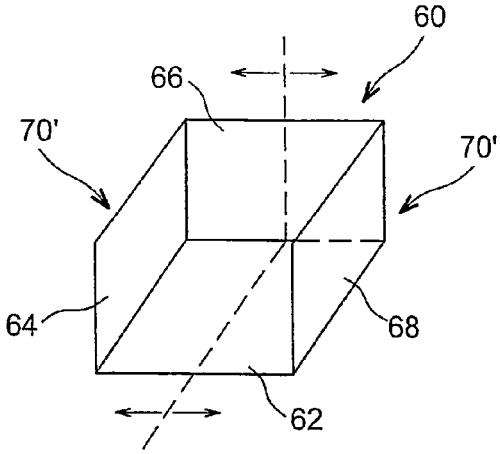
FIG. 5 illustrates another object obtained by the weaving according to the invention.

It is particularly possible to make a structure 60 comprising a base 62 and three continuous orthogonal faces 64, 66, 68. This is particularly advantageous for making corner fittings 10: the structure 60 formed is then cut into two parallel to the two opposite faces 64, 68 so as to form two corner angles 70, 70': see FIG. 5. The same option is offered for a demi parallelepiped with four faces and a base.

Even though described with a corner cube angle, other possibilities are feasible. In particular, it is possible to offset the first face 12 obliquely, to form faces 12, 14, 16 non-orthogonal to one another, for example to form an acute-angled pyramid. It is likewise possible not to carry out weaving at right angles on the first face 12.

According to the use of the resulting corner 40, in particular in the case of the use of carbon threads for reinforcing composite structures, it is preferable for the weft thread 24, 32 to be continuous from the start of the weaving process to the finish. Advantageously, insertion of the pick is mechanised, with the presence of an insertion system comprising a shuttle, or a system based thereon, to ensure continuity of the thread.

Similarly, it is preferable for the cramming comb of each pick to be unitary for the different faces, so as to proceed once the entire angle is complete. Therefore, the parallel orientation of the weft threads relative to the first face is optimised.

Due to the process according to the invention, an elementary fold 40 for corner fitting 10 according to FIG. 2 was fabricated, in which the dimensions are of the order of 400×220×200 mm, with a carbon thread comprising 6000, 12000 and 24000 filaments.

More generally, the process according to the invention produces a corner, or several, whereof the thread can be continuous, due to non-rectilinear insertion. This is particularly advantageous since existing three-dimensional machines produce only "dense" (cubic, cylindrical) or profiled forms (T, H, E, . . . ): here, this is about producing a three-dimensional form with bidimensional walls. In addition, this system responds to needs in terms of thread continuity. Also, the movement according to the axis z joins together the forms of the three-dimensional fold, thus greatly facilitating its fabrication during its weaving phase.

What is claimed is:

1. A weaving process for making three-dimensional structures with bidimensional walls including a first face, a second face, and a third face connected to one another by three ridges joining together in a corner and in which the threads of the weaving weft are continuous between the faces, the process comprising:

a) placing a warp thread web intended for weaving of the first face;

b) weaving the web by threads of primary ply to form the first face, the weft threads being prolonged on an edge of the first face so as to form a web of secondary ply threads for the second face;

c) once the first face is woven, inserting a secondary ply thread in the web of primary ply threads and in the web of secondary ply threads, in this order or in the inverse order, so as to obtain a continuous thread forming an angle about the first face, d) offsetting in a direction including a component normal for webs of the first face by a distance greater than or equal to the fabric thickness formed by the secondary ply thread; and e) repeating the inserting c) and offsetting d) to form the second and third faces.

2. The process according to claim 1, in which the structure further includes a fourth face and a second corner, and in which, during the inserting c), the secondary ply thread forms the two corners, by being inserted into the web of primary ply threads, then into the web of secondary ply threads, then into the web of primary ply threads on the other side of the first face.

3. The process according to claim 1, in which the structure further includes an additional face and an additional corner, the process further comprising, during the weaving b), extension of the secondary weft threads on the other side of the first face and in which, during the inserting c), the secondary ply thread also forms the additional corner, by being inserted into the web of secondary ply threads, then into the web of primary ply threads, then into the web of secondary ply threads on the other side of the first face.

4. The process according to claim 1, in which the weaving b) of the first face is carried out according to a right-angled weave.

5. The process according to claim 4, further comprising, once the first face is woven and prior to the inserting c) of the secondary ply thread forming an angle, offsetting in a direction including a normal component with webs of the first face by a distance greater than or equal to the fabric thickness formed by the secondary ply thread.

6. The process according to claim 1, in which the offsetting d) of the first face relative to the webs includes a thrust exerted at least at the level of the ridges of the first face, and preferably the whole surface.

7. The process according to claim 6, in which the thrust is exerted at a right-angled downwards relative to the plane of the webs.

8. The process according to claim 1, in which each weft thread is continuous.

9. The process according to claim 8, in which the thread of primary ply is unitary with the secondary ply thread, as well as with the warp thread.

* * * * *